US006722270B2

(12) United States Patent
Koyama

(10) Patent No.: US 6,722,270 B2
(45) Date of Patent: Apr. 20, 2004

(54) HYDRAULIC PRESS

(75) Inventor: Kunio Koyama, Aichi-ken (JP)

(73) Assignee: Nippo Industry Co., Ltd. (JP)

( * ) Notice: Subject to any disclaimer, the term of this patent is extended or adjusted under 35 U.S.C. 154(b) by 0 days.

(21) Appl. No.: 10/285,720

(22) Filed: Nov. 1, 2002

(65) Prior Publication Data

US 2003/0084794 A1 May 8, 2003

(30) Foreign Application Priority Data

Nov. 2, 2001 (JP) ..... 2001-337365

(51) Int. Cl.[7] ..... B30B 1/32

(52) U.S. Cl. ..... 100/269.01; 72/453.18; 60/476; 60/413

(58) Field of Search ..... 100/269.01, 269.14, 100/269.15, 269.16, 269.18, 269.19, 270, 271, 273; 72/453.18, 453.01, 453.07, 453.09, 453.06; 60/413, 414, 417, 418, 446, 448, 476, 451, 487; 137/38, 46

(56) References Cited

U.S. PATENT DOCUMENTS 3,691,946 A * 9/1972 Ando ..... 100/269.05
5,568,766 A * 10/1996 Otremba et al. ..... 100/35
6,145,307 A * 11/2000 Dantlgraber ..... 60/327
6,240,758 B1 * 6/2001 Nagakura ..... 72/20.1

* cited by examiner

*Primary Examiner*—Allen Ostrager
*Assistant Examiner*—Jimmy Nguyen
(74) *Attorney, Agent, or Firm*—Muserlian, Lucas and Mercanti

(57) ABSTRACT

A hydraulic press which is small in the temperature rise of hydraulic oil, which can dispense with a water-cooling cooler, which is compact in size and which can realize energy saving is provided. A pressure receiving area of a high speed descent first cylinder chamber 51 and a pressure receiving area of a high speed ascent second cylinder chamber 52—are set equal to each other, and a closed circuit which ranges from the second cylinder chamber 52 to the first cylinder chamber 51 through a hydraulic passage 31, a hydraulic pump 7 and a hydraulic passage 34 is constituted. Using an alternating current servo motor 6, the number of revolutions of the hydraulic pump 7 in positive and counter directions is controlled to thereby control advancement and regress speeds and pressure of a piston member 54.

15 Claims, 6 Drawing Sheets

HYDRAULIC PRESS

BACKGROUND OF THE INVENTION

1. Field of the Invention

The present invention relates to a hydraulic press and particularly relates to a hydraulic press suited for sheet metal formation.

2. Description of the Related Art

To manufacture the door, food, trunk lid or the like of a vehicle, hem-press for peening an inner component and an outer component at their edges is conducted. To this end, a hydraulic press is employed. According to a conventional hydraulic press, a hydraulic pump is constantly driven by an induction motor. If no oil is supplied to a hydraulic cylinder, pressure oil is returned to a tank by an unload valve. This causes the temperature rise of the oil, requires a water-cooling cooler or the like which water-cools the hydraulic oil and consumes lots of energy (power).

The conventional hydraulic press has the following disadvantage. If a single hydraulic cylinder is employed, pressure oil in large quantities and much time are required to elevate dies, with the result that productivity deteriorates. To solve this disadvantage, there is proposed in JP-A-2000-254799 (to be referred to as "Reference 1" hereinafter) that a screw sliding driver 15 and a hydraulic cylinder sliding driver 22 are disposed in parallel, the screw sliding driver 15 is employed for fast elevation and the hydraulic cylinder sliding driver 22 is employed only to pressurize a workpiece. In addition, there is proposed in JP-A-10-263888 (to be referred to as "Reference 2" hereinafter) that a high speed cylinder 36 for elevation and a pressure cylinder 37 for pressurizing a workpiece are employed. Further, there is proposed in JP-A-10-180499 (to be referred to as "Reference 3" hereinafter) that a first cylinder 24 for pressurizing a workpiece, a second cylinder 25 for descending the workpiece and a third cylinder 26 for ascending the workpiece are provided and a hydraulic pump 17 is driven by an alternating current servo motor 18, thereby accurately controlling a ram 6.

Nevertheless, according to Reference 1, since the screw sliding driver 15 and the hydraulic cylinder sliding driver 22 are provided, the structure of this hydraulic press and control over the hydraulic press are disadvantageously complicated. According to Reference 2, since the two cylinders 36 and 37 are connected in series and have large heights, the hydraulic press becomes disadvantageously large in size. Further, according to Reference 2, since a servo valve 52 is employed to adjust the pressure and quantity of oil, the hydraulic press has disadvantageously heavy energy loss. According to Reference 3, although the alternating current servo motor 18 is employed, the hydraulic pump 17 connected to the motor 18 discharges oil in one direction but cannot discharge oil in a counter direction. Due to this, the alternating current servo motor 18 controls only the number of revolutions and torque of the pump 17 and not control the pump 17 to make a counter rotation. As a result, return oil from the respective cylinders 24, 25 and 26 is returned to the tank 16, in which tank energy loss and the temperature rise of the oil disadvantageously occur.

SUMMARY OF THE INVENTION

It is, therefore, an object of the present invention to provide a hydraulic press which has the smaller temperature rise of hydraulic oil, which can dispense with a water-cooling cooler or the like, which can be made compact in size and which can realize energy saving.

In order to achieve the above mentioned object, a hydraulic press according to the present invention as shown in FIG. 2 is characterized by comprising:

- a multi-cylinder including a first cylinder chamber 51 having a small pressure receiving area and used for reciprocation, a second cylinder chamber 52 having an equal pressure receiving area to the pressure receiving area of the first cylinder chamber 51, a third cylinder chamber 53 having a large pressure receiving area and used for reciprocation, and an integral piston member 54 partitioning the respective cylinder chambers 50;
- a constant volume, reversible hydraulic pump 7, and a servo motor 6, driving the hydraulic pump 7 to rotate in positive and counter directions;
- a closed hydraulic circuit 31 and 34 connecting said first cylinder chamber 51 to said second cylinder chamber 52 through said hydraulic pump 7;
- an automatic supply hydraulic circuit 32 connecting said third cylinder chamber 53 to an oil tank 1 through said automatic supply valve 23;
- a pressurization hydraulic circuit 35 connecting one of discharge ports of said hydraulic pump 7 to the third cylinder chamber 53 through a check valve 27;
- a pressure sensor 28 detecting oil pressure of said third cylinder chamber 53; and
- a controller 80 controlling said servo motor 6 based on a signal from said pressure sensor 28.

According to the present invention, a first cylinder chamber 51 is employed as a quick feed and pressurization cylinder, a second cylinder chamber 52 is employed as a quick return cylinder and a third cylinder chamber 53 is employed as a pressurization cylinder. During quick feed, a closed hydraulic circuit which ranges from the second cylinder chamber 52 to the first cylinder chamber 51 through a hydraulic circuit 31, a hydraulic pump 7 and a hydraulic circuit 34 is formed. Since the pressure receiving area of the first cylinder chamber 51 is set equal to that of the second cylinder chamber 52, the quantity of hydraulic oil discharged from the second cylinder chamber 52 is equal to that supplied to the first cylinder chamber 51. Due to this, the hydraulic oil discharged from the hydraulic pump 7 is only passed through the closed hydraulic circuit comprising the second cylinder chamber 52, the hydraulic circuit 31, the hydraulic pump 7, the hydraulic circuit 34 and the first cylinder 51 and not returned to an oil tank 1. Accordingly, no energy loss and no temperature rise of the hydraulic oil occur. It is noted that the hydraulic oil of the oil tank 1 is sucked to the pressurization third cylinder chamber 53 through an automatic supply hydraulic circuit 32 and an automatic supply valve 23 by negative pressure.

Likewise, during quick return, a closed hydraulic circuit which ranges from the first cylinder chamber 51 to the second cylinder chamber 52 through the hydraulic circuit 34, the hydraulic pump 7 and the hydraulic circuit 31 is formed. By driving the hydraulic pump 7 to rotate in a counter direction, the hydraulic oil is fed from the first cylinder chamber 51 to the second cylinder chamber 52 to thereby regress a piston member 54. As in the case of the quick feed, no energy loss and no temperature rise of the hydraulic oil occur. It is noted that the hydraulic oil of the third cylinder chamber 53 is relieved to the oil tank 1 through the automatic supply valve 23 and the automatic supply hydraulic circuit 32. In this way, during the quick feed and quick return, the hydraulic oil is automatically sucked and discharged to and from the third cylinder chamber 53, thereby decreasing the discharge quantity of the hydraulic pump 7 and making the hydraulic pump 7 small in size.

When pressure is applied, the automatic supply valve 23 is closed. In addition, the hydraulic circuit 34 which communicates with the hydraulic pump 7 is connected to the pressurization hydraulic circuit 35 which communicates with the third cylinder chamber 53. By driving the hydraulic pump 7 to rotate in a positive direction, the hydraulic oil is fed to the third cylinder chamber 53 and the first cylinder chamber 51 and the piston member 54 is pressed out with pressure received by a pressure receiving area which is a combination of the pressure receiving area of the third cylinder chamber 53 and that of the first cylinder chamber 51. At this moment, the oil pressure of the third cylinder chamber 53 is detected by a pressure sensor 28 and the number of revolutions of the servo motor 6 is controlled so as to provide appropriate pressure. In this way, the oil pressure is controlled not by a servo valve but by a servo motor 6, i.e., controlled according to the number of revolutions and torque of the hydraulic pump 7. Therefore, energy loss is small and the temperature rise of the hydraulic oil is small. Moreover, a change in the tact system of the hydraulic press such as a change in press pressure according to a workpiece can be easily made by only electrically changing settings in a controller 80 and changing control over the number of revolutions of the servo motor 6 and the like.

In a standby state, the servo motor 6 and the hydraulic pump 7 stop and pressure oil is not relieved from an unload valve. Therefore, no energy loss and no temperature rise of the hydraulic oil occur. As can be seen, in the hydraulic press of the present invention, the temperature rise of the hydraulic oil hardly occurs and it is unnecessary to provide a cooling unit. The present invention exhibits an advantage in that a hydraulic press which contributes to energy saving and which is compact in size can be provided.

According to the present invention, the constant volume reversible hydraulic pump 7 can be a vane pump.

If so, the vane pump has less pulsation of discharge pressure. Therefore, noise is decreased and press pressurization force is stabilized.

According to the present invention, the constant volume, reversible hydraulic pump 7 can be a piston pump.

If so, the piston pump can obtain a discharge quantity with less error, high speed rotation and high pressure. Therefore, it is possible to realize a high speed, high pressure hydraulic press by using a small-sized-cylinder.

According to the present invention, as shown in FIG. 1, the hydraulic press according to the present invention is characterized in that said controller 80 comprises means for controlling said servo motor 6 based on a signal from a position sensor 91 detecting a position of said piston member 54 or a position of a ram 205, a slider 204 or the like integral with the piston member 54.

By thus forming the hydraulic press, it is possible to accurately control a location and the like for changing the piston member 54 from high speed movement to low speed, high pressure movement. It is also possible easily change the tact system of the hydraulic press by changing settings in the controller 80.

According to the present invention, as shown FIG. 5, the hydraulic press according to the present invention is characterized in that said controller 80 comprises:

a rotation detector 92 detecting rotation of said servo motor 6; means for storing a total number of revolutions of said servo motor 6 based on output of the rotation detector 92; and means for specifying a position of a ram 205 or a slider 204 from the stored total number of revolutions, and for controlling said servo motor 6 based the specified position of the ram 205 or the slider 204.

By so forming, the closed hydraulic circuit which ranges from the second cylinder chamber 52 to the first cylinder chamber 51 through the hydraulic circuit 31, the hydraulic pump 7 and the hydraulic circuit 34 is formed. Since the hydraulic pump 7 is a constant volume, reversible hydraulic pump, the total number of revolutions of the servo motor 6 (the number of revolutions thereof in counter direction is counted as negative), i.e., the total number of revolutions of the hydraulic pump 7 corresponds to the volume of the hydraulic oil discharged to either the cylinder chamber 51 or 52. It is, therefore, possible to specify the position of the piston member 54 from the total number of revolutions and to accurately control the location at which the piston member 54 changes from the high speed movement to the low speed, high pressure movement. Further, it is possible to easily change the tact system of the hydraulic press by changing settings in the controller 80. Besides, since a detector 92 is attached to the servo motor 6, a wiring can be easily arranged.

DESCRIPTION OF THE PREFERRED EMBODIMENTS

The embodiment of the present invention will be described hereinafter with reference to the drawings.

Figure 1:
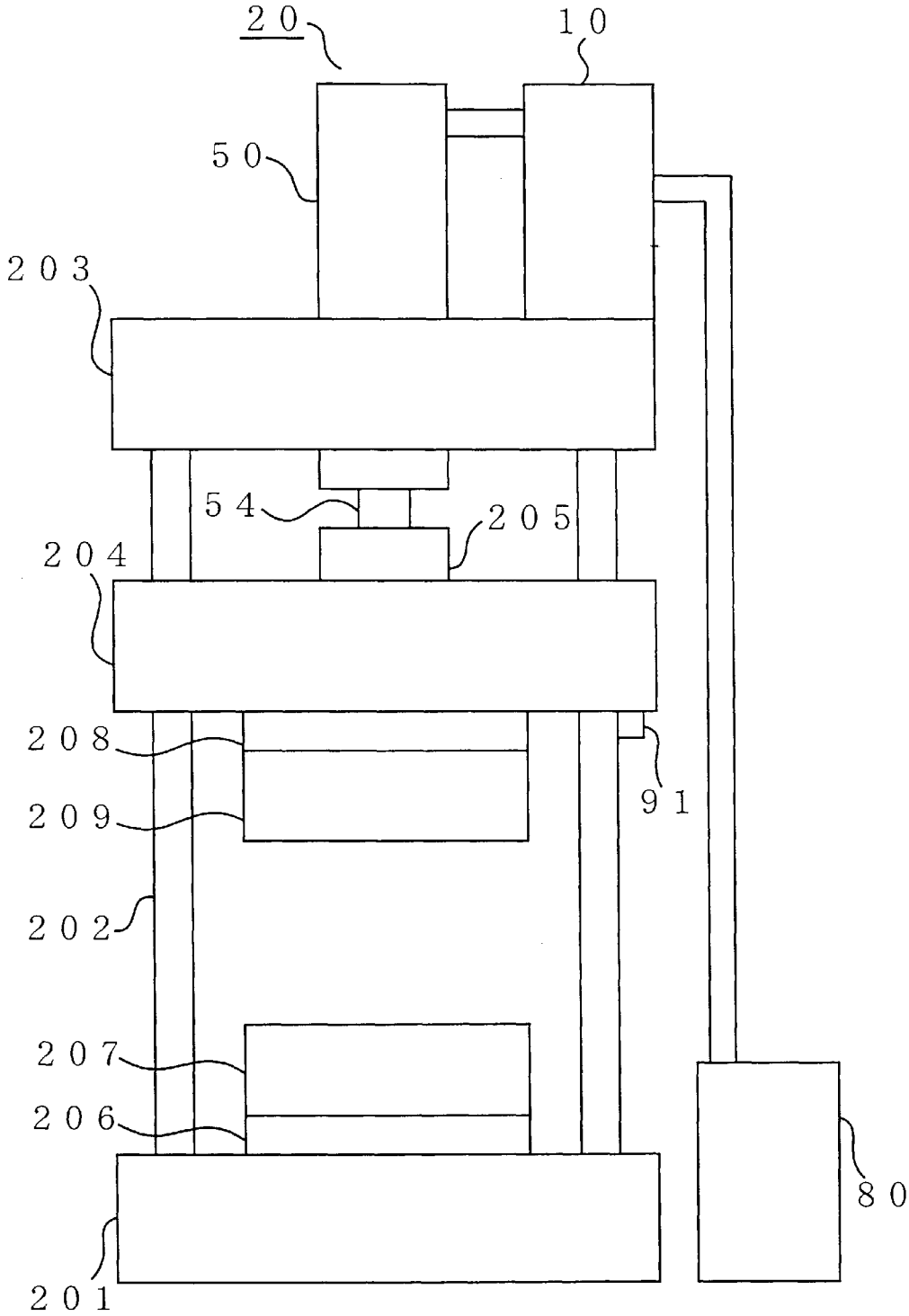
FIG. 1 is a front view showing a hydraulic press according to the present invention.

FIG. 1 is a front view showing a hydraulic press according to a preferred embodiment. In FIG. 1, four columns 202 are built on a bed 201 and a crown 203 is fixed onto the columns 202. A cylinder unit 20, which comprises hydraulically operated unit 10, a multi-cylinder 50 and an attachment to the cylinder 50, is provided on the crown 203. A controller 80 which electrically drives and controls the hydraulically operated unit 10 is disposed on the ground. A slider 204, which can be freely elevated, is supported by the columns 202. The slider 204 is fixed to the piston member 54 of the multi-cylinder 50 through a ram 205 and elevated according to the advancement and regress of the piston member 54. A position detector 91 which detects the elevated position of the slider 204 is attached to the slider 204. A bolster 206 is fixed onto the bed 201 and a lower die 207 is fixed to the upper portion of the bolster 206. An upper plate 208 is fixed to the slider 204 and an upper die 209 is fixed to the lower portion of the upper plate 208.

Figure 2:
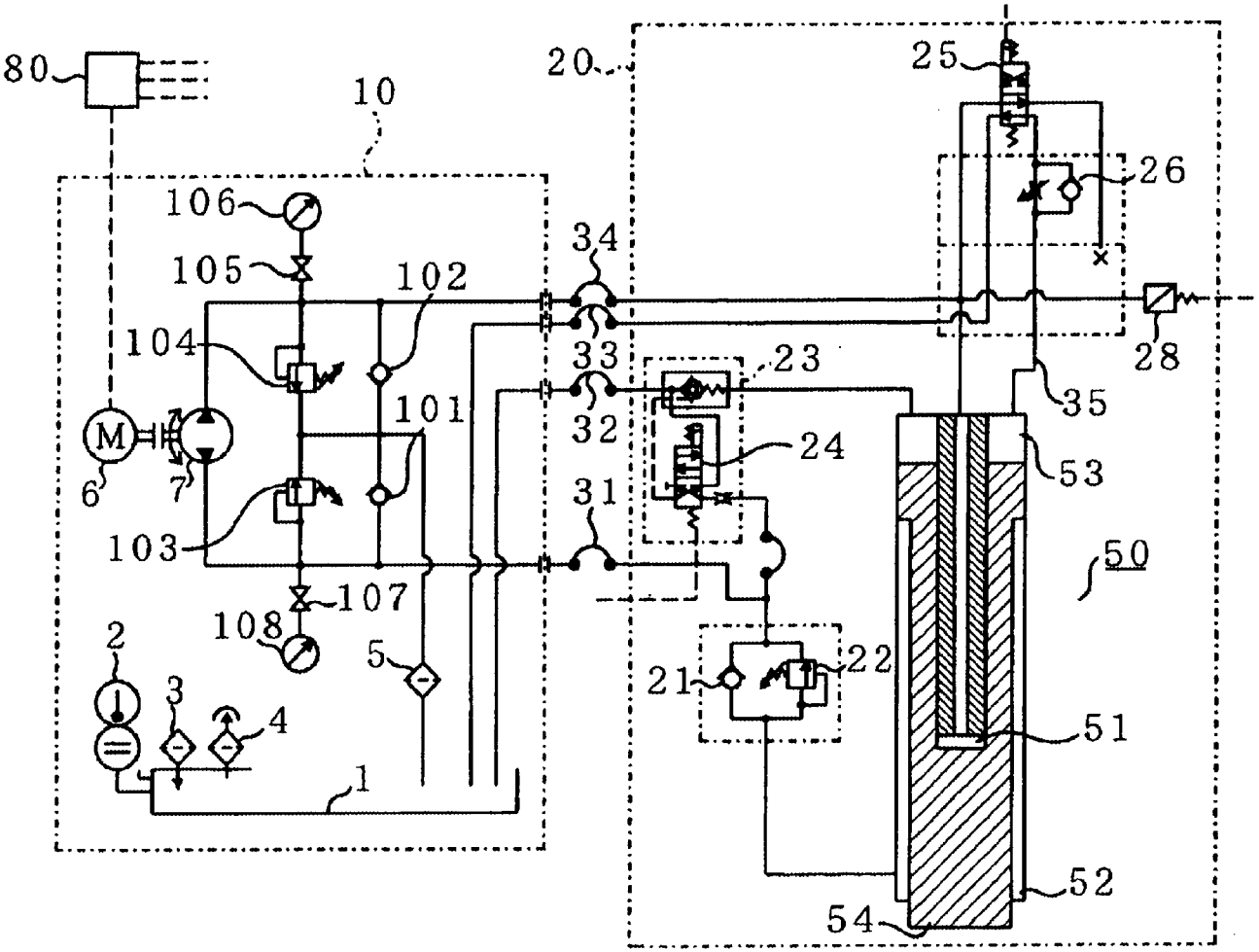
FIG. 2 is a hydraulic circuit diagram of the hydraulic press according to the present invention.

FIG. 2 is a hydraulic circuit diagram of the hydraulic press. In FIG. 2, the hydraulically operated unit 10, the cylinder unit 20 and the controller 80 which controls the units 10 and 20 are shown. The hydraulically operated unit 10 mainly comprises an alternating current servo motor 6, a hydraulic pump 7 which comprises a vane pump driven to rotate in two directions by the alternating servo motor 6 and discharging hydraulic oil in the two directions, and an oil tank 1. The power of the alternating servo motor 6 is 11 Kw and the number of revolution thereof is 2000 rpm. The hydraulic pump 7 is a high pressure vane pump which has a maximum discharge pressure of 32 Mpa and a discharge quantity of 28 cc/rev and which can discharge oil in two directions.

As hydraulic passages which are directly connected to the hydraulic pump 7, there are provided a positive-rotation hydraulic passage 34 through which pressure oil is fed if the hydraulic pump 7 is driven to rotate in a positive direction and a counter-rotation hydraulic passage 31 through which the pressure oil is fed if the hydraulic pump 7 is driven to rotate in a counter direction. On the counter-rotation hydraulic passage 31, the hydraulic oil of the oil tank 1 can be sucked through a check valve 101 and a suction filter 5. On the positive-rotation hydraulic passage 34, the hydraulic oil of the oil tank 1 can be sucked through a check valve 102 and the suction filter 5. In addition, a relief valve 104 which serves as an oil pressure limiter is provided on the positive-rotation hydraulic passage 34. If the oil pressure of the positive-rotation hydraulic passage 34 exceeds 31 Mpa, the relief valve 104 returns the hydraulic oil to the oil tank 1. Likewise, a relief valve 103 is provided on the counter-rotation hydraulic passage 31 to return the hydraulic oil to the oil tank 1 if the oil pressure of the counter-rotation hydraulic passage 31 exceeds 17 Mpa. These relief valves 103 and 104 function as safety valves, respectively.

An oil pressure gauge 106 is connected to the positive-rotation hydraulic passage 34 through a gauge valve 105. An oil pressure gauge 108 is connected to the counter-rotation hydraulic passage 31 through a gauge valve 107. An oil gauge 2, a filter 3 and an air breather 4 are attached to the oil tank 1.

The alternating current servo motor 6 is connected to the controller 80 by an electric wiring and driven to rotate in both positive and counter directions by the controller 80. The hydraulically operated unit 10 is connected to the cylinder unit 20 by the positive-rotation hydraulic passage 34, the counter-rotation hydraulic passage 31 and two other hydraulic passages 32 and 33 which are connected to the oil tank 1, i.e., by a total of four hydraulic passages 31, 32, 33 and 34.

The cylinder unit 20 comprises a multi-cylinder 50 and an attachment thereto. The multi-cylinder 50 includes three cylinder chambers 51, 52 and 53 which are partitioned by the piston 54. The first cylinder chamber 51 which has a circular pressure receiving surface in the central portion of the multi-cylinder 50, is provided for quick feed and pressurization. The second cylinder chamber 52 which has an annular pressure receiving surface in the peripheral portion thereof, is provided for high speed return. The pressure receiving area of the second cylinder chamber 52 is set equal to that of the first cylinder chamber 51. The upper or third cylinder chamber 53 which has a large pressure receiving area and is provided for pressurization.

The positive-rotation hydraulic passage 34 directly communicates with the first cylinder chamber 51. The counter-rotation hydraulic passage 31 communicates with the second cylinder chamber 52 through a parallel circuit which comprises a check valve 21 and a counterbalance valve 22. The counterbalance valve 22 is a relief valve which becomes conductive if the oil pressure fed from the second cylinder chamber 52 is not lower than predetermined pressure and which relieves the hydraulic oil of the second cylinder chamber 52 to the counter-rotation hydraulic passage 31. Accordingly, by adjusting the relief pressure of the counterbalance valve to be equal to pressure corresponding to the weight of the upper die 209 or the like shown in FIG. 1, it is possible to counterbalance the pressure. Furthermore, since the first cylinder chamber 51 is equal in pressure receiving area to the second cylinder chamber 52, a closed hydraulic circuit which is constituted by the first cylinder chamber 51, the positive-rotation hydraulic passage 34, the hydraulic pump 7, counter-rotation hydraulic passage 31, the check valve 21 or counterbalance valve 22, and the second cylinder chamber 52, is formed. As far as the hydraulic oil in this closed hydraulic circuit is concerned, the hydraulic oil is only moved in the closed hydraulic circuit and not moved to the oil tank 1 or the like whether the hydraulic pump 7 is driven to rotate in the positive or counter direction.

The hydraulic passage 32 from the oil tank 1 communicates with the third cylinder chamber 53 through an automatic supply valve 23. If the first solenoid valve 24 is turned on, the automatic supply valve 23 is opened to make it possible to suck the hydraulic oil from the oil tank 1 into the third cylinder chamber 53 or return the hydraulic oil from the third cylinder chamber 53 to the oil tank 1. If the first solenoid valve 24 is turned off, the hydraulic oil is prevented from being returned from the third cylinder chamber 53 to the oil tank 1. The hydraulic passage 32 and the automatic supply valve 23 constitute an automatic supply hydraulic circuit.

Further, the positive-rotation hydraulic passage 34 communicates with the third cylinder chamber 53 through a second solenoid valve 25, a throttle check valve 26, a check valve 27 and a hydraulic passage 35. If the second solenoid valve 25 is turned on, the oil pressure of the positive-rotation hydraulic passage 34 is applied to the third cylinder chamber 53. A hydraulic circuit which is constituted by the hydraulic pump 7, the hydraulic passage 34, the second solenoid valve 25, the throttle check valve 26, the check valve 27, the hydraulic passage 35 and the third cylinder chamber 53, functions as a pressurization hydraulic circuit. A pressure sensor 28 is attached to the hydraulic passage 35. The pressure sensor 28 converts the oil pressure of the third cylinder chamber 53 into an electric signal and transmits the electric signal to the controller 80. Further, the other port of the second solenoid valve 25 communicates with the oil tank 1 by the hydraulic passage 33 so as to relieve surge pressure which is generated if the second solenoid valve 25 is turned off. The first solenoid valve 24 and the second solenoid valve 25 are electrically connected to the controller 80 and controlled to be turned on and off by the controller 80.

Figure 3:
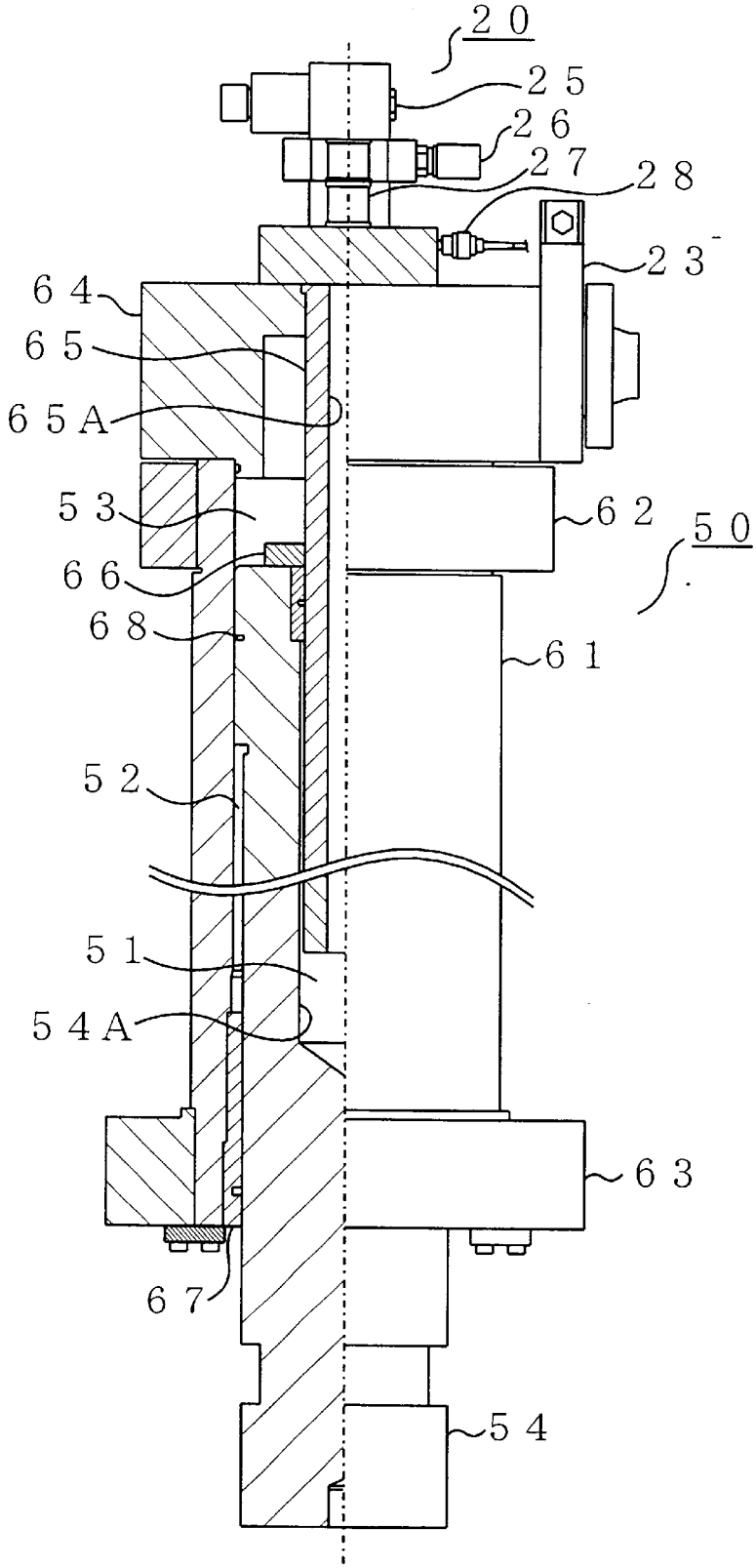
FIG. 3 is a front view of a cylinder unit in which cross section of the left half of the cylinder unit is shown.
Figure 4:
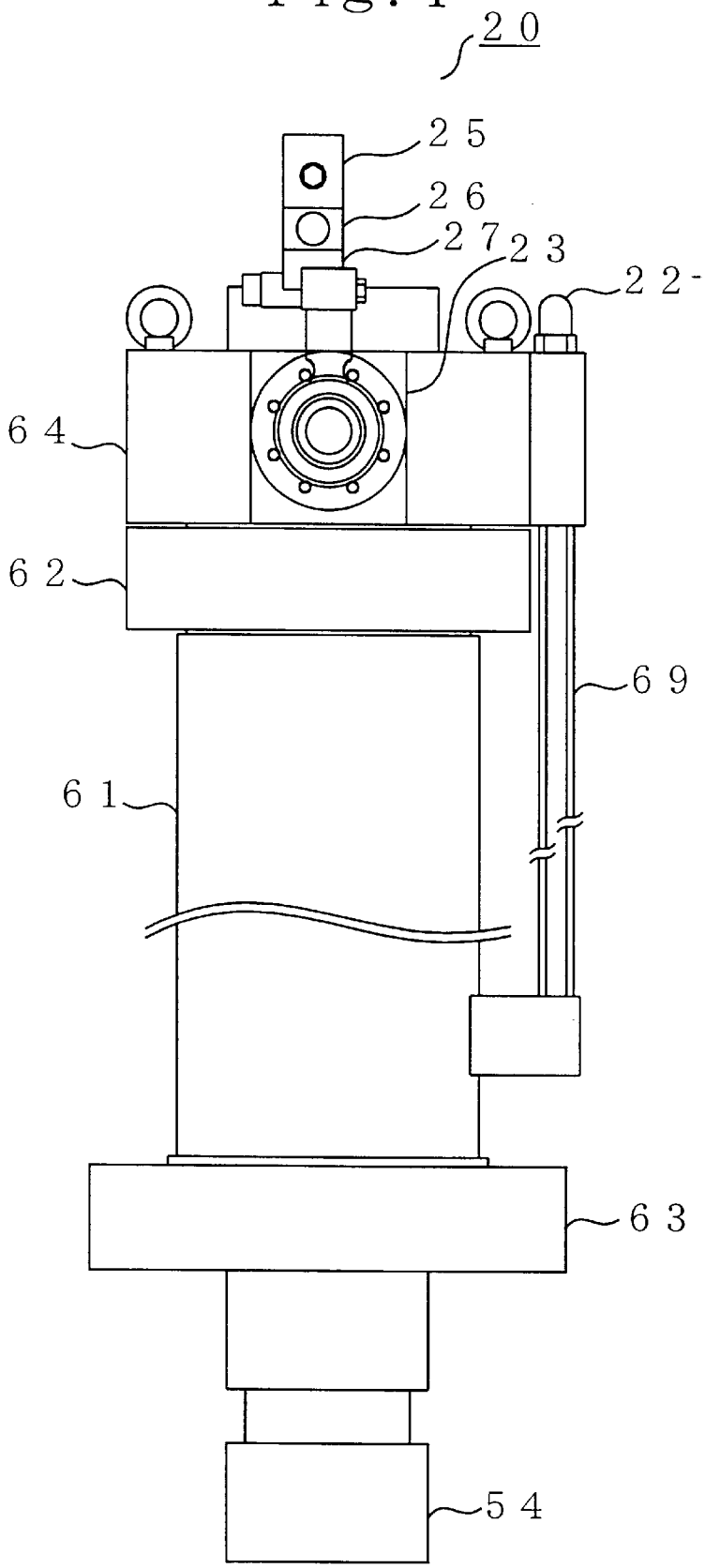
FIG. 4 is a side view of the cylinder unit.

FIG. 3 is a front view of the cylinder unit 20 which shows the cross-section of the left half of the cylinder unit 20. FIG. 4 is a side view of the cylinder unit 20. It is noted that both FIGS. 3 and 4 show that a length direction is cut out and shortened. An upper flange 62 and a lower flange 63 are connected to the upper and lower portions of a cylinder body 61, respectively. A head cover block 64 is fixed to the upper flange 62. A kicker rod 65 is extended over and fixed to the central portion of the cylinder body 61. A central hole 65A is formed at the center of the kicker rod 65 to vertically open the kicker rod 65. The piston 54 is fitted into the cylinder body 61 from below. A hole 54A is formed at the center of the piston body 54 so as to insert the kicker rod 65 into the hole 54A. The piston member 54 is formed to have two outer diameter sections. The upper diameter section is set to be equal to the inside diameter of the cylinder body 61 to $\phi$ 260 (mm) and the diameter of the lower section is slightly reduced to $\phi$ 240 (mm). The outside diameter of the kicker rod 65 is set at $\phi$ 100 (mm).

A first seal member 66 is provided above the piston member 54 between the outside diameter section of the kicker rod 65 and the hole 54A of the piston member 54 and partitioned oiltight. A second seal member 67 is provided between the inside diameter section of the lower end of the cylinder body 61 and the reduced diameter section (ϕ 240) of the piston member 54 and partitioned oiltight. Further, a third seal member 68 which slidably contacts with the inside diameter section of the cylinder body 61 is provided above the large diameter section (ϕ 260) of the piston member 54 and partitioned oiltight. As a result, the multi-cylinder 50 which is constituted by the cylinder body 61, the head cover block 64, the kicker rod 65, the piston member 54 and the like, includes the cylindrical first cylinder chamber 51 which is partitioned by the hole 54A of the piston member 54 and the kicker rod 65, the annular second cylinder chamber 52 which is partitioned by the inner wall (ϕ 260) of the cylinder body 61 and the reduced diameter section (ϕ 240) of the piston member 54, and the annular third cylinder chamber 53 which is partitioned by the inner wall of the cylinder body 61, the outer wall of the kicker rod 65, the upper surface of the piston member 54 and the like.

Meanwhile, if the hydraulic oil is supplied to the first cylinder chamber 51, the hydraulic oil functions to descend the piston member 54. Since the outside diameter section of the kicker rod 65 is sealed by the first seal member 66, the effective pressure receiving area of the first cylinder chamber 51 is equal to the cross-sectional area of the outside diameter (ϕ 100) of the kicker rod 65, i.e., $\pi\times25\ cm^2=78.5\ cm^2$. If supplied to the second cylinder chamber 52, the hydraulic oil functions to ascend the piston member 54. Since the second cylinder chamber 52 is an annular chamber having a diameter of ϕ 260−ϕ 240, the pressure receiving area of the second cylinder chamber 52 is $\pi\times(13^2-12^2)=\pi\times(169-144)=\pi\times25\ cm^2$. That is, the hydraulic press is formed so that the pressure receiving area of the first cylinder chamber 51 is equal to that of the second cylinder chamber 52. If the hydraulic oil is supplied to the third cylinder chamber 53 (ϕ 260), the hydraulic oil functions to descend the piston member 54. If the hydraulic oil is supplied to the third cylinder chamber 53 to apply pressure to the piston member 54, the hydraulic oil is also supplied to the first cylinder chamber 51 to apply pressure thereto. Therefore, the pressure receiving areas of the two cylinder chambers 51 and 53 amount to $\pi\times13^2=\pi\times169\ cm^2=530.7\ cm^2$.

On the head cover block 64, a block to which the pressure sensor 28 is attached, a block of the check valve 27, a block of the throttle check valve 26, and the second solenoid valve 25 are stacked to be integrated with one another. Further, the automatic supply valve 23 is attached to the right side surface of the head cover block 64. Referring to FIG. 4, the counterbalance valve 22 is attached to the right side surface of the head cover block 64. The counterbalance valve 22 is connected to the side portion of cylinder body 61 by a pipe 69 to thereby communicate with second cylinder chamber 52. The above-stated members thus constitute the cylinder unit 20.

Figure 5:
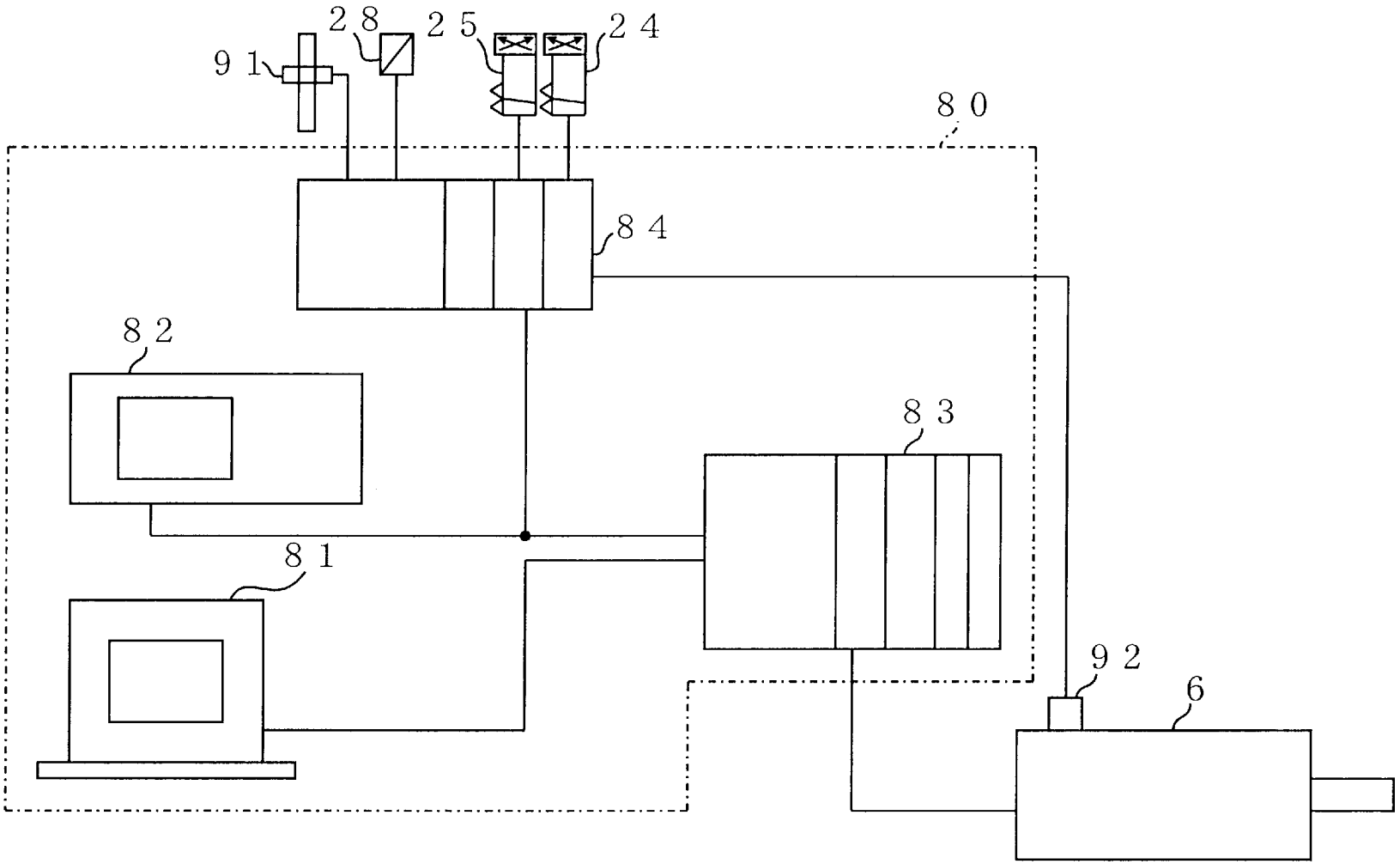
FIG. 5 is a block diagram showing a controller.

FIG. 5 is a block diagram showing the controller 80. The controller 80 includes a computer (PC) 81 which controls the entirety of the controller 80, a touch panel 82 which inputs press conditions and the like, a servo motor controller 83 which drives the alternating current servo motor 6 to rotate, and an interface panel 84 which inputs and outputs data into and from an external equipment. The first solenoid valve 24 and the second solenoid valve 25 are connected to the interface panel 84 to be on/off controlled. Further, a signal from the pressure sensor 28 is input into the interface panel 84 to thereby convey the oil pressure of the third cylinder chamber 53. A rotary encoder 92 is attached to the servo motor 6 so that rotating information on the servo motor 6 is transmitted to the interface panel 84. Further, a signal is input from the position detector 91 which comprises an encoder and which detects the position of the slider 204 shown in FIG. 1 is input into the interface panel 84.

Figure 6:
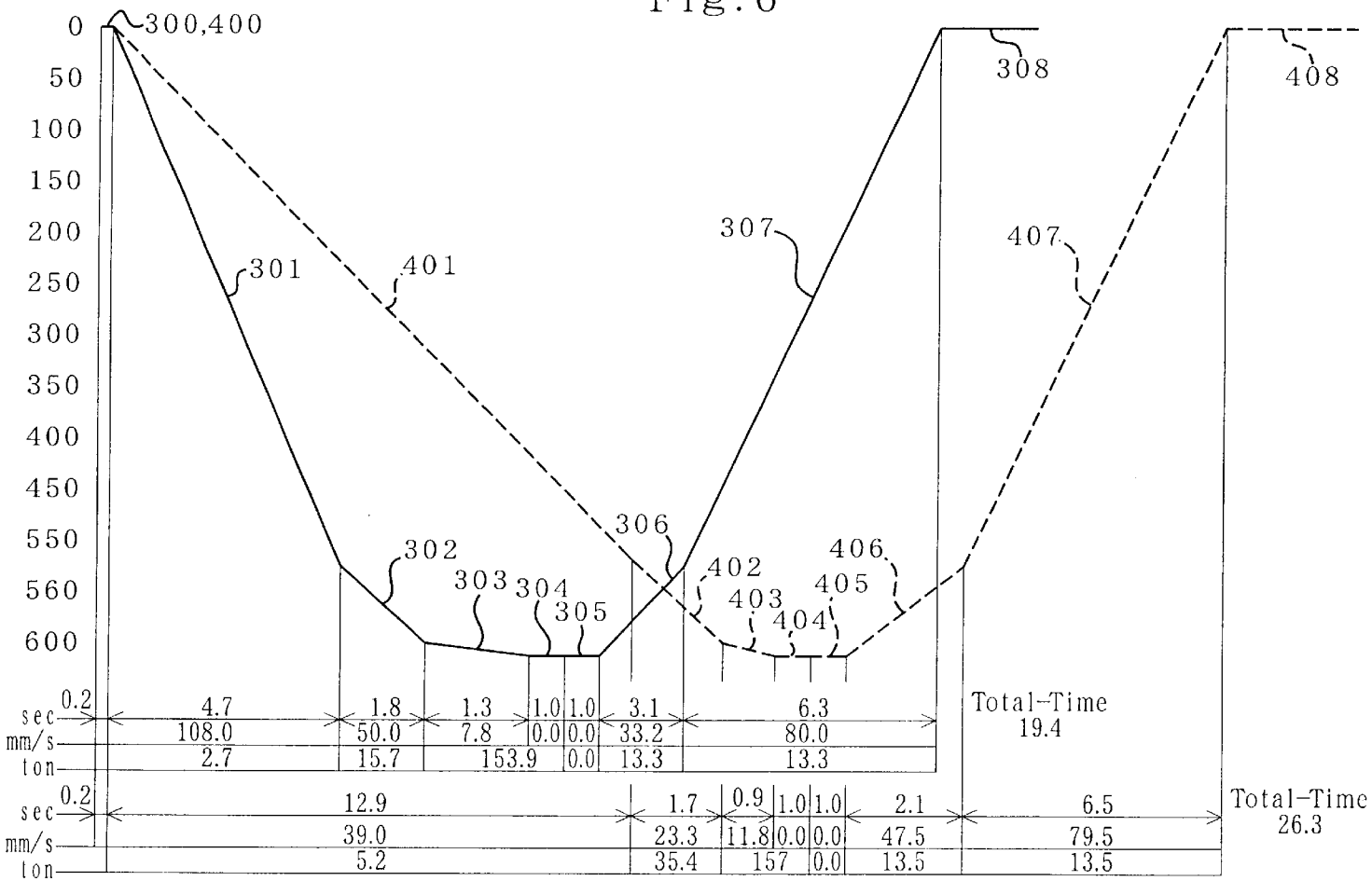
FIG. 6 is a performance chart for explaining the operation of the hydraulic press.

The operation of the hydraulic press in this embodiment will be described based on the above-stated configuration. FIG. 6 is a performance chart for explaining the operation of the hydraulic press. In FIG. 6, the vertical axis indicates the descent distance (mm) of the piston member 54, i.e., the slider 204 and the horizontal axis indicates time (sec). Polygonal lines 300 to 308 and 400 to 408 show that the slider 204 descends and ascends. The polygonal line 300 to 308 indicated by solid lines shows the operation of the hydraulic press of the present invention whereas the polygonal line 400 to 408 indicated by broken lines shows that of a conventional hydraulic press which employs a three phase induction motor. The operation of the hydraulic press according to the present invention indicated by the solid lines will first be described while referring to FIG. 6 as well as FIG. 2.

The solid line 300 shows a preparatory operation step. In this step, the first solenoid valve 24 is turned on for 0.2 seconds to turn the automatic supply valve 23 into an open state. The second solenoid valve 25 is kept to be turned off.

The solid line 301 shows a step of descending the hydraulic press at high speed. In this step, the alternating current servo motor 6 is driven to rotate at high speed in the positive direction with the number of revolutions of 2000 rpm. The hydraulic oil discharged from the hydraulic pump 7 is fed to the first cylinder chamber 51 through the positive rotation hydraulic passage 34. While the hydraulic oil discharged from the second cylinder chamber 52 is returned to the hydraulic pump 7 through the counterbalance valve 22 and the counter rotation hydraulic passage 31. Since the pressure receiving area of the first cylinder chamber 51 is set equal to that of the second cylinder chamber 52, a closed circuit which ranges from the second cylinder chamber 52 to the first cylinder chamber 51 through the counterbalance valve 22, the counter-rotation hydraulic passage 31, the hydraulic pump 7, and the positive-rotation hydraulic passage 34 is formed, and the hydraulic oil discharged from the second cylinder chamber 52 is entirely injected into the first cylinder chamber 51 through the hydraulic pump 7. The hydraulic oil of the oil tank 1 is sucked into the third cylinder chamber 53 through the hydraulic passage 32 and the automatic supply valve 23.

The high speed press descent is continued until the piston member 54 descends by about 500 mm. During this descent, the discharge pressure of the hydraulic pump 7 is 3.5 Mpa and the pressure force of the piston member 54 is 2.7 tons. The descent speed of the piston member 54 is 108 mm/s and it takes 4.7 seconds to make a high speed descent. If the piston member 54 descends by about 500 mm, the position detector 91 detects this descent and the controller 80 drives the alternating current servo motor 6 to rotate at low speed. As a result, the high speed press descent step moves to a step of descending the press at low speed.

The solid line 302 shows the low speed press descent. In this step, the hydraulic circuit remains unchanged, the number of revolutions of the alternating current servo motor 6 is decreased and the piston member 54 decelerates and descends at a speed of 50 mm/s for 1.8 seconds. At this time, since the alternating current servo motor 6 is controlled so that the discharge pressure of the hydraulic pump 7 can rise to a maximum of 20 Mpa, the maximum pressure force of the piston member 54 becomes 15.7 tons. The low speed press descent continues to reach the position of about 600 mm for 1.8 seconds.

The solid line 303 shows a step of pressurizing the press. In this step, the first solenoid valve 24 is turned off and the second solenoid valve 25 is turned on. As a result, the automatic supply valve 23 is closed and the second solenoid valve 25 is opened. Consequently, the hydraulic oil discharged from the hydraulic pump 7 is fed to the first cylinder chamber 51 through the positive-rotation hydraulic passage 34 and also fed to the third cylinder chamber 53 through the pressurizing hydraulic passage 35. The hydraulic oil fed to the third cylinder chamber 53 having a diameter as large as ϕ 260 is sucked through the suction filter 5, the check valve 101 and the hydraulic passage 31 and supplied to the hydraulic pump 7. Since the effective pressure receiving areas of the cylinder chambers 51 and 53 to which the hydraulic oil discharged from the hydraulic pump 7 is supplied, increase, the descent speed of the piston member 54 further decreases and the piston member 54 slowly descends at a speed of 7.8 mm/s for 1.3 seconds. At this moment, the alternating current servo motor 6 is controlled so that the discharge pressure of the hydraulic pump 7 can rise to a maximum of 29.0 Mpa and the maximum pressure force of the piston member 54 becomes 153.9 tons. During this, a workpiece which is mounted on the lower die 207 is pressurized by the upper die 209 and plastically deformed. By slowly descending the upper die 209, the material of the plastically deformed workpiece orderly flows to improve the finished pressed workpiece.

The solid line 304 shows a step of holding the pressurization of the press. In this step, the plastic deformation of the workpiece is finished and the upper die 209 completes with pressing the workpiece. The alternating current servo motor 6 is controlled to hold the discharge pressure of the hydraulic pump 7 to be, for example, 29.0 Mpa in a state in which the piston member 54 is stopped, thereby holding the pressure force of the piston member 54 to be 153.9 tons. This press pressurization holding step continues for 1.0 second.

The solid line 305 shows a step of evacuating the press. In this step, the pressure of each of the cylinder chambers 51 and 53 is decreased nearly to 0 Mpa as slowly as about 1 second. This step is executed by controlling the rotation of the alternating current servo motor 6. If the pressure of each of the cylinder chambers 51 and 53 becomes 0 Mpa, the second solenoid valve 25 is turned off to relieve residual pressure. Through this step, it is possible to obtain the well finished, pressed workpiece.

The solid line 306 shows a step of ascending the press at low speed. In this step, the first solenoid valve 24 is turned on so that the hydraulic oil of the third cylinder chamber 53 can be relieved to the oil tank 1 through the automatic supply valve 23 and the hydraulic passage 32. Thereafter, the alternating current servo motor 6 is driven to rotate in counter direction at low speed. As a result, the hydraulic oil is passed through the closed circuit which ranges from the first cylinder chamber 51 to the second cylinder chamber 52 through the positive-rotation hydraulic passage 34, the hydraulic pump 7, the counter-rotation hydraulic passage 31 and the check valve 21 and supplied to the second cylinder chamber 52 to thereby ascend the piston member 54 up to the position of about 500 mm. The hydraulic oil of the third cylinder chamber 53 is returned to the oil tank 1. In this step, it takes 3.1 seconds, the ascent speed of the piston member 54 is 33.2 mm/s and the ascent force of the piston member 54 is 13.3 tons.

The solid line 307 shows a step of ascending the press at high speed. In this step, the hydraulic circuit remains unchanged and the alternating current servo motor 6 is driven to rotate in the counter direction at high speed. As a result, the piston member 54 ascends to an ascent end and stops. It takes 6.3 seconds, the ascent speed of the piston member 54 is 80.0 mm/s and the ascent force of the piston member 54 is 13.3 tons.

The solid line 308 shows a standby step. During this step, workpiece replacement or the like is conducted. In this standby step, the alternating current servo motor 6 remains stopped and the hydraulic pump 7 remains stopped, too. Therefore, no unnecessary flow of the hydraulic oil occurs, making it possible to realize energy saving. Further, total time for one cycle of the solid lines 300 to 307 is 19.4 seconds.

As can be understood from the above, since the vane pump is employed as the hydraulic pump 7 in this embodiment, it is possible to provide the press which has less pulsation of oil pressure and which has a noise value as low as 68 dB. In addition, as stated above, in the steps such as the high speed press descent step and the high speed press ascent step, other than the press pressuring step 303 and the press pressurization holding step 304, the hydraulic oil is automatically sucked and discharged to the third cylinder chamber 53. Therefore, the discharge quantity of the hydraulic pump 7 can be made small and the hydraulic pump 7 can be made small in size. Further, since the high pressure vane pump at the maximum pressure of 32 Mpa is employed, it is possible to decrease noise and make the press small in size. Moreover, since the touch panel 82 in the controller 80 can easily change and adjust the tact system of the hydraulic press to facilitate dealing with the change and the like of the workpiece.

The operation of the conventional press indicated by the broken lines in FIG. 6 will be briefly described. The broken lines 400 to 408 correspond to the solid lines 300 to 308, respectively. Namely, the broken line 400 shows a preparatory operation step, 401 shows a high speed press descent step, 402 shows a low speed press descent step, 403 shows a press pressurizing step, 404 shows a press pressurization holding step, 405 shows a press evacuation step, 406 shows a low speed press ascent step, 407 shows a high speed press ascent step and 408 shows a standby step. Time required for one cycle of the broken lines 400 to 407 is 26.3 seconds in all.

The conventional 150-ton press employs an alternating current induction motor of 22 Kw. The alternating current induction motor drives the hydraulic pump to rotate with a constant number of revolutions of 1200 rpm, and increases a current in accordance with load torque to thereby increase the power of the motor. In other words, in the conventional press, the hydraulic pump continues to rotate at a constant speed in a constant direction and the steps 400 to 408 are executed by changing over the valve of the hydraulic circuit. Due to this, it is necessary to relieve the high pressure hydraulic oil to the oil tank, resulting in energy loss.

In the press pressurization holding step 404 indicated by the broken line 404 in which the workpiece is pressurized and made stationary at high pressure, for example, the quantity of generated heat is 15,730 kcal/h. According to the hydraulic press of the present invention, by contrast, the quantity of generated heat is only 204 kcal/h in the press pressurization holding step indicated by the solid line 304.

This is because the rotation of the alternating current servo motor 6 is controlled to thereby control pressure. Further, in the standby step indicated by the broken line 408, it is required to return all of the hydraulic oil to the oil tank using the unload valve, so that the hydraulic oil is heated with the quantity of generated heat of 1,875 kcal/h. According to the hydraulic press of the present invention, by contrast, the hydraulic pump 7 is stopped in the standby step indicated by the solid line 308 and the quantity of generated heat in this step is 0 kcal/h. In the standby step, it takes considerable time for the replacement of the workpiece and the like. Due to this, this energy loss becomes disadvantageously substantial within the total operation time of the hydraulic press.

The embodiment has been described while the hydraulic pump 7 is assumed as a vane pump. Alternatively, a piston pump may be employed as the hydraulic pump 7. Although the pulsation of the heat pump is slightly greater than that of the vane pump, the heat pump can characteristically generate high pressure and can be employed for high speed rotation.

In an example of the experiment made by the inventor of the present invention using the same cylinder unit 50, a heat pump which has a maximum discharge pressure of 40 Mpa, a maximum number of revolutions of 5000 rpm and a discharge quantity of 28 cc and which can discharge oil in two directions is employed. Although the same servo motor of 11 kW and 2000 rpm as the servo motor of the above-stated embodiment can be employed, a servo motor of 15 kW and 5000 rpm is employed to utilize high speed rotation. As a result, the speed of the high speed descent step 301 and that of the high speed ascent step 307 are doubled from those shown in FIG. 6, respectively. In addition, in the press pressurization step 303 and the press pressurization holding step 304, it is possible to maintain the discharge pressure of the hydraulic pump 7 to be 40.0 Mpa and to increase the pressure force of the piston member 54 to 200 tons. Besides, in the low speed ascent step 306, the ascent force of the piston member 54 is improved to 15 tons. It is noted that the noise value of the piston pump is higher than that of the vane pump to 75 dB. It is, however, lower than that of the conventional hydraulic press.

In the block diagram shown in FIG. 5, the position detector 91 such as an encoder which directly detects the position of the slider 204 and the rotary encoder 92 attached to the servo motor 6 are shown as elements for detecting the protruding position of the piston member 54. Actually, however, it suffices to employ one of these elements. If the position detector 91 is employed, the position detector 91 can advantageously directly detect the position of the slider 204. In addition, the computer 81 determines a point for moving the high speed press descent step 301 to the low speed press descend step 302, a point for moving the low speed press descent step 302 to the press pressurization step 303 and a point for moving the low speed press ascent step 306 to the high speed press ascent step 307 to thereby control the servo motor 6 and the like. This method advantageously facilitates control.

If the rotary encoder 92 is employed, the volume of the hydraulic oil discharged to either the cylinder chamber 51 or 52 is calculated from the total (accumulation value) of the number of revolutions of the servo motor 6 to thereby calculate the position of the piston member 54. Further, a point for moving the high speed press descent step 301 to the low speed press descent step 302 and the like are detected to thereby control the servo motor 6 and the like. This method is advantageous in that the rotary encoder 92 is attached to the servo motor 6 and a wiring can be easily arranged. Alternatively, the computer 81 may directly fetch the rotation data held in the servo motor controller 83 which controls the alternating current servo motor 6 to calculate the total number of revolutions of the alternating current servo motor 6.

As stated so far, according to the present invention, the closed hydraulic circuit is constituted and the hydraulic pump is controlled to rotate in both positive and counter directions by the servo motor. Therefore, the present invention exhibits an excellent advantage in that a hydraulic press which has the small temperature rise of the hydraulic oil, which can dispense with a water-cooling cooler or the like, which can operate at high speed, which is compact in size and which can realize energy saving.

Although the invention has been disclosed in the context of a certain preferred embodiments, it will be understood that the present invention extends beyond the specifically disclosed embodiments to other alternative embodiments of the invention. Thus, it is intended that the scope of the invention should not be limited by the disclosed embodiments but should be determined by reference to the claims that follow.

What is claimed is:

1. A hydraulic press comprising:

a multi-cylinder comprising a first cylinder chamber employed as a quick feed and pressurization cylinder having a small pressure receiving area and used for reciprocation, a second cylinder chamber employed as a quick return cylinder having an equal pressure receiving area to the pressure receiving area of the first cylinder chamber, a third cylinder chamber employed as a pressurization cylinder having a large pressure receiving area and used for reciprocation, and an integral piston member partitioning the respective cylinder chambers in said multi-cylinder;

a constant volume, reversible hydraulic pump, and a servo motor driving the hydraulic pump to rotate in positive and counter directions;

a closed hydraulic circuit connecting said first cylinder chamber to said second cylinder chamber through said hydraulic pump;

an automatic supply hydraulic circuit connecting said third cylinder chamber to an oil tank through an automatic supply valve;

a pressurization hydraulic circuit connecting one of discharge ports of said hydraulic pump to the third cylinder chamber through a check valve;

a pressure sensor detecting oil pressure of said third cylinder chamber; and a controller controlling said servo motor based on a signal from said pressure sensor.

2. The hydraulic press according to claim 1, wherein said constant volume, reversible hydraulic pump is a vane pump.

3. The hydraulic press according to claim 1, wherein said constant volume, reversible hydraulic pump is a piston pump.

4. The hydraulic press according to claim 1, wherein said controller comprises means for controlling said servo motor based on a signal from a position sensor detecting a position of said piston member or a position of a ram, a slider or the like integral with the piston member.

5. The hydraulic press according to claim 2, wherein said controller comprises means for controlling said servo motor based on a signal from a position sensor detecting a position of said piston member or a position of a ram, a slider or the like integral with the piston member.

6. The hydraulic press according to claim 3, wherein said controller comprises means for controlling said servo motor based on a signal from a position sensor detecting a position of said piston member or a position of a ram, a slider or the like integral with the piston member.

7. The hydraulic press according to claim 1, wherein said controller comprises: a rotation detector detecting rotation of said servo motor; means for storing a total number of revolutions of said servo motor based on output of the rotation detector; and means for specifying a position of a ram or a slider from the stored total number of revolutions, and for controlling said servo motor based the specified position of the ram or the slider.

8. The hydraulic press according to claim 2, wherein said controller comprises: a rotation detector detecting rotation of said servo motor; means for storing a total number of revolutions of said servo motor based on output of the rotation detector; and means for specifying a position of a ram or a slider from the stored total number of revolutions, and for controlling said servo motor based the specified position of the ram or the slider.

9. The hydraulic press according to claim 3, wherein said controller comprises: a rotation detector detecting rotation of said servo motor; means for storing a total number of revolutions of said servo motor based on output of the rotation detector; and means for specifying a position of a ram or a slider from the stored total number of revolutions, and for controlling said servo motor based the specified position of the ram or the slider.

10. A hydraulic press comprising:

a multi-cylinder comprising a first cylinder chamber employed as a quick feed and pressurization cylinder having a small pressure receiving area and used for reciprocation, a second cylinder chamber employed as a quick return cylinder having an equal pressure receiving area to the pressure receiving area of the first cylinder chamber, a third cylinder chamber employed as a pressurization cylinder having a large pressure receiving area and used for reciprocation, and an integral piston member partitioning the respective cylinder chambers;

a constant volume, reversible hydraulic pump, and a servo motor driving the hydraulic pump to rotate in positive and counter directions;

a closed hydraulic circuit connecting said first cylinder chamber to said second cylinder chamber through said hydraulic pump;

an automatic supply hydraulic circuit connecting said third cylinder chamber to an oil tank through an automatic supply valve;

a pressurization hydraulic circuit connecting one of discharge ports of said hydraulic pump to the third cylinder chamber through a check valve;

a pressure sensor detecting oil pressure of said third cylinder chamber; and a controller controlling said servo motor based on a signal from said pressure sensor wherein said controller further comprises a rotation detector detecting rotation of said servo motor, means for storing a total number of revolutions of said servo motor based on output of the rotation detector, and means for specifying a position of a ram or a slider from the stored total number of revolutions, and for controlling said servo motor based the specified position of the ram or the slider.

11. The hydraulic press according to claim 10, wherein said constant volume, reversible hydraulic pump is a vane pump.

12. The hydraulic press according to claim 10, wherein said constant volume, reversible hydraulic pump is a piston pump.

13. The hydraulic press according to claim 10, wherein said controller comprises means for controlling said servo motor based on a signal from a position sensor detecting a position of said piston member or a position of a ram, a slider or the like integral with the piston member.

14. The hydraulic press according to claim 11, wherein said controller comprises means for controlling said servo motor based on a signal from a position sensor detecting a position of said piston member or a position of a ram, a slider or the like integral with the piston member.

15. The hydraulic press according to claim 12, wherein said controller comprises means for controlling said servo motor based on a signal from a position sensor detecting a position of said piston member or a position of a ram, a slider or the like integral with the piston member.

* * * * *